US006003246A

United States Patent [19]

Pan

[11] Patent Number: 6,003,246

[45] Date of Patent: Dec. 21, 1999

[54] SLIPPER HAVING GOOD DRAINING FUNCTIONS AND PROVIDING ENHANCED SUPPORT

[76] Inventor: Kung-Sheng Pan, 7F, No. 19-28, Chung Yung Rd., Nan Tun Area, Taichung, Taiwan

[21] Appl. No.: 09/196,163

[22] Filed: Nov. 20, 1998

[51] Int. Cl.[6] ..... A43B 3/12; A43B 5/08

[52] U.S. Cl. ..... 36/11.5; 36/8.1

[58] Field of Search ..... 36/11.5, 3 R, 3 B, 36/8.1

[56] References Cited

U.S. PATENT DOCUMENTS

| | | | |
|---|---|---|---|
| Re. 20,609 | 12/1937 | Dunbar | 36/3 B |
| 900,881 | 10/1908 | Parker | 36/11.5 |
| 2,932,097 | 4/1960 | George | 36/11.5 |
| 4,078,321 | 3/1978 | Famolare, Jr. | 36/3 B |
| 4,294,023 | 10/1981 | Banford | 36/11.5 |
| 4,939,851 | 7/1990 | Miller | 36/3 B |

FOREIGN PATENT DOCUMENTS

| | | | |
|---|---|---|---|
| 999645 | 11/1955 | France | 36/11.5 |
| 347406 | 4/1937 | Italy | 36/11.5 |
| 692309 | 6/1953 | United Kingdom | 36/11.5 |

*Primary Examiner*—M. D. Patterson
*Attorney, Agent, or Firm*—Browdy and Neimark

[57] ABSTRACT

A slipper having good draining functions and providing enhanced support, including an outsole having a top face provided with a pre-determined number of raised portions along its periphery, and a pre-determined number of water outlets each being located between two adjacent raised portions; an insole formed by a multiplicity of interwoven elastic filaments and having a pre-determined thickness and multiple gaps, the insole being disposed on the top face of the outsole and being surrounded by the raised portions; and an upper secured to the outsole such that it forms an arching receiving space adapted to receive a user's foot. The slipper allows water to drain away quickly, and the raised portions provide a stopping function to the toes of the user's foot when the user advances.

7 Claims, 3 Drawing Sheets

SLIPPER HAVING GOOD DRAINING FUNCTIONS AND PROVIDING ENHANCED SUPPORT

BACKGROUND OF THE INVENTION (a) Field of the Invention

The present invention relates generally to footwear, and more particularly to a slipper that has good draining functions and that provides enhanced support to the user's feet.

(b) Description of the Prior Art

In additional to leather shoes, footwear includes leisure footwear or slippers for use at home, or during traveling or hiking. There are many types of slippers. There are two main types of soles for conventional slippers. In the first type, a covering is provided on the top face of the sole of the slipper. The covering may be made of leather of cloth, and in use, the user's foot steps on the covering. The cover provides softness and air ventilation so as to make the slipper comfortable to wear. In the second type, there is not provided a covering on the sole of the slipper, and the user's sole touches the top face of the slipper's sole in use.

However, the common problem of conventional slippers is that if the slipper is immersed in water when the user washes the bathroom or wade, across water, for example, water cannot easily drain away. For slippers with covering, the covering will absorb the water, which will not evaporate rear As for slippers without the covering, water will accumulate between the sole and the top face of the sole of the slipper and cannot evaporate readily.

For the user, it is very uncomfortable to wear wet slippers. Besides, germs may breed easily in a wet environment, which will affect the hygiene of the user's feet.

Furthermore, in conventional slippers, the user's soles are not completely enclosed and may be exposed on the outside. If the user stops suddenly in the midst of walking or running or walks down a slope, the user's feet have to bear the thrust of the user's body or support the user's body to prevent the user from sliding downwardly. However, conventional slippers cannot provide proper support to the user's feet.

SUMMARY OF THE INVENTION

A primary object of the present invention is to provide a slipper having good draining functions and provides enhanced support so that water will not accumulate in the slipper.

Another object of the present invention is to provide a slipper having good draining functions and provides enhanced support so as to provide better use effects with respect to the user's motion.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
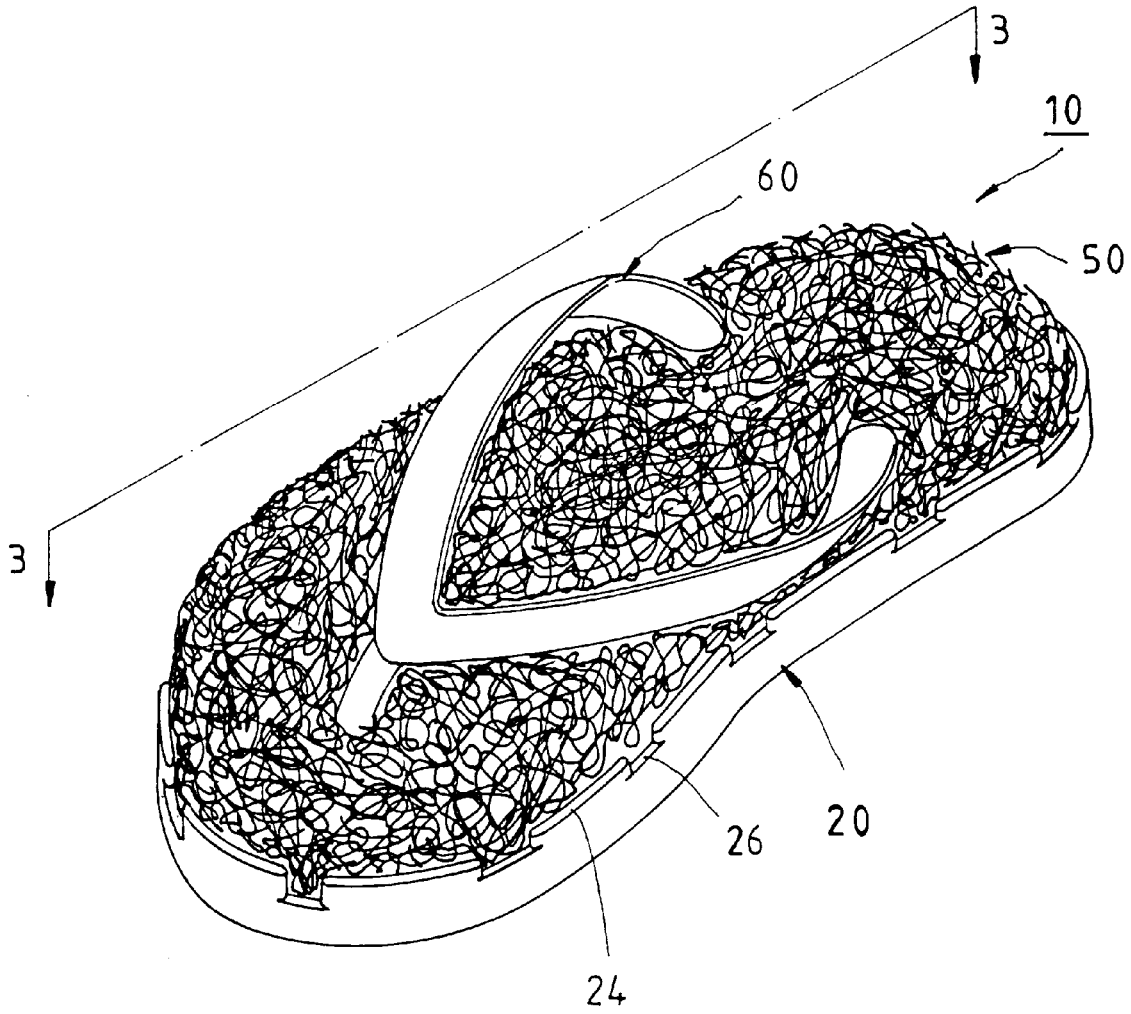
FIG. 1 is a perspective view of a preferred embodiment of the present invention.
Figure 2:
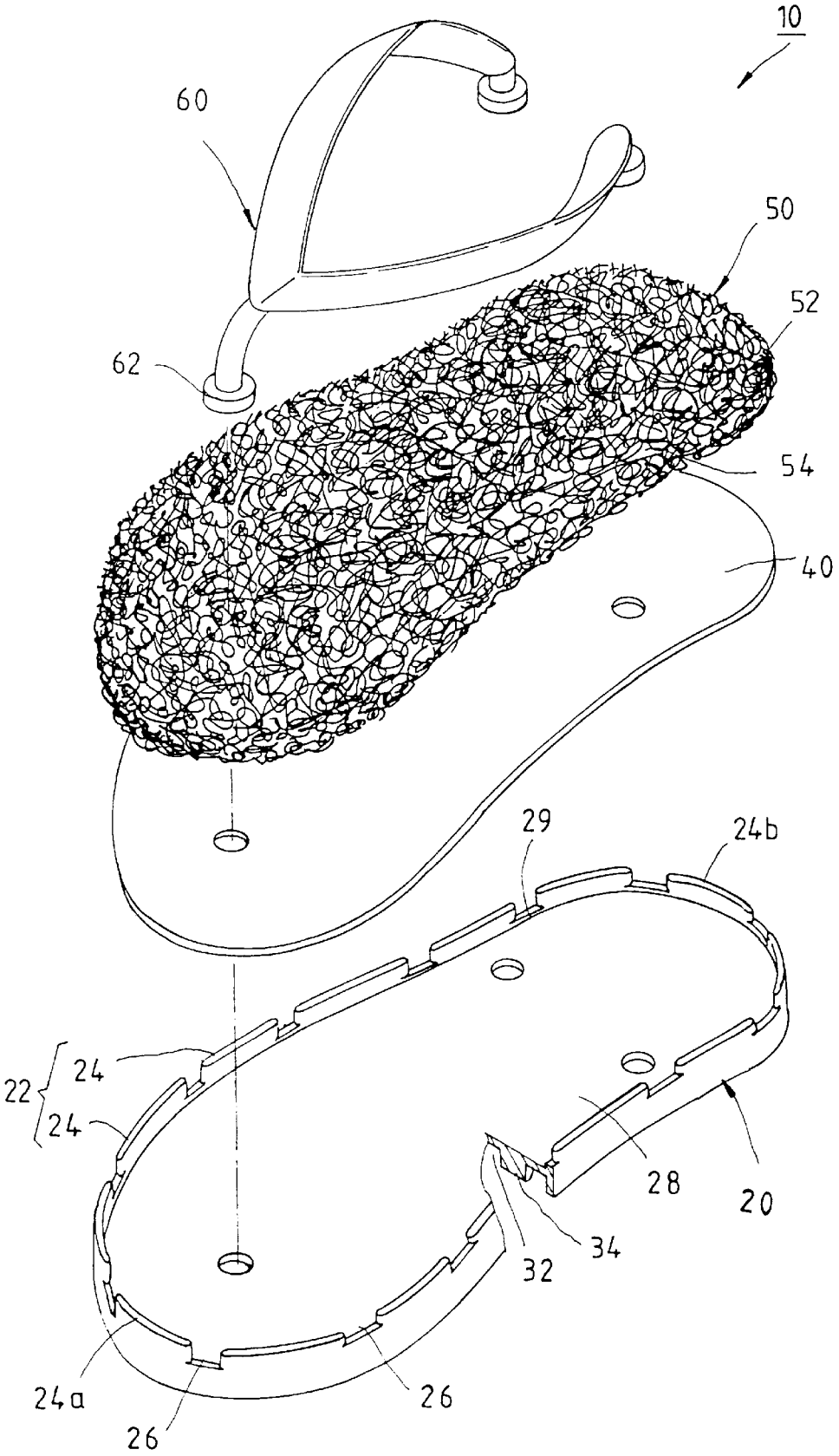
FIG. 2 is a perspective exploded view of the preferred embodiment of the present invention.

With reference to FIGS. 1 and 2, a preferred embodiment of a slipper having good draining functions and enhanced support according to the present invention comprises an outsole 20, a plate 40, an insole 50, and an upper 60.

Figure 3:
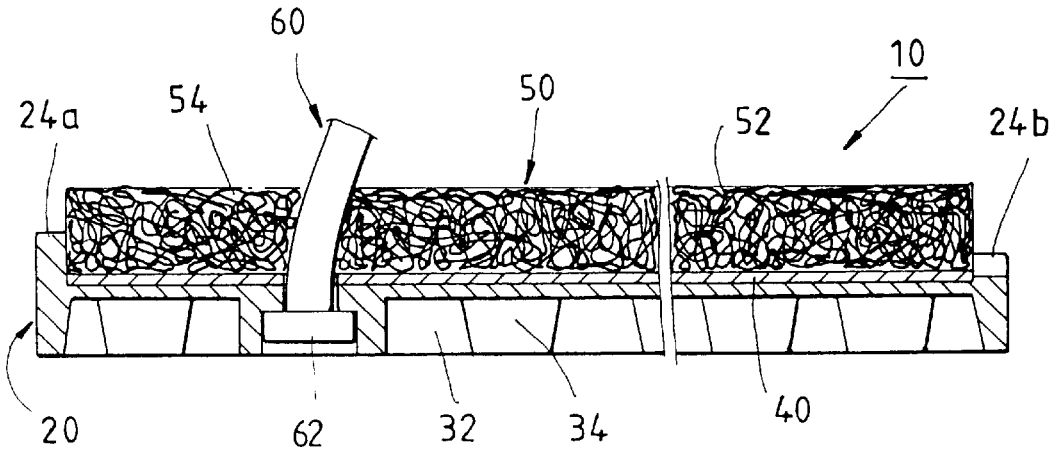
FIG. 3 is a sectional view taken along line 3—3 of FIG. 1.

The outsole 20 is made from flexible materials. A raised wall 22 extends upwardly from a top face of the outsole 20 along its periphery, and the raised wall 22 is provided with a plurality of notches along its edge. Thus, a plurality of strip-like raised portions 24 of a pre-determined length are thus formed on the top face of the outsole 20 along its periphery, with a water outlet 26 having bottom edge 26' defined between two adjacent raised portions 24. The top face of the outsole 20 within the raised wall 22 forms a top surface 28 which is depressed below bottom edges 26'. Thus, there is a slight drop in height between the top surface 28 and bottom edges 26' of the water outlets 26 so as to define a shoulder 29. In addition, the raised portions 24*a* at the front edge of the outsole 20 may be at a higher position than the remaining raised portions 24*b*, as shown in FIG. 3.

Furthermore, the bottom face of the outsole 20 may be an inwardly recessed space 32 in which a plurality of downwardly extending spaced projections 34 are provided to enhance the friction between the outsole 20 and the ground.

The plate 40 is made of a soft material and is attached to the top surface 28 of the sole 20.

The insole 50 is a structure of a pre-determined thickness and is formed by a multiplicity of elastic filaments 52 of PVC intertwined and woven together loosely. The elastic filaments 52 give the insole 50 a pre-determined thickness, and there are multiple pores or gaps 54 among them. The insole 50 is attached to the upper side of the plate 40 which is disposed on the top face of the sole 20 in the top surface 28. Plate 40 is surrounded by the raised portions 24 and shoulders 29. The bottom edge of the insole 50 is slightly above [see FIG. 3] or substantially at the same height as the bottom edges 26" of the water outlets 26. The gaps 54 have the effects of ventilation and draining. Besides, the intertwined elastic filaments 52 are soft to the sole of the wearer, and the user will feel very comfortable due to the elastic support of the elastic filaments 52.

The upper 60 may be in any form and is not restricted to the one shown in the accompanying drawings. The upper 60 is secured to the outsole so as to form an arching receiving space adapted to receive the foot of the user. The upper 60 may, as shown in the drawings, have connecting portions that extend through the insole 50 and the plate 40 to be secured to the outsole 20. If the 20 upper 60 has a form other than the one as shown (such as that commonly seen in slippers on the market), the upper 60 may be directly secured to the periphery of the outsole 20.

Figure 4:
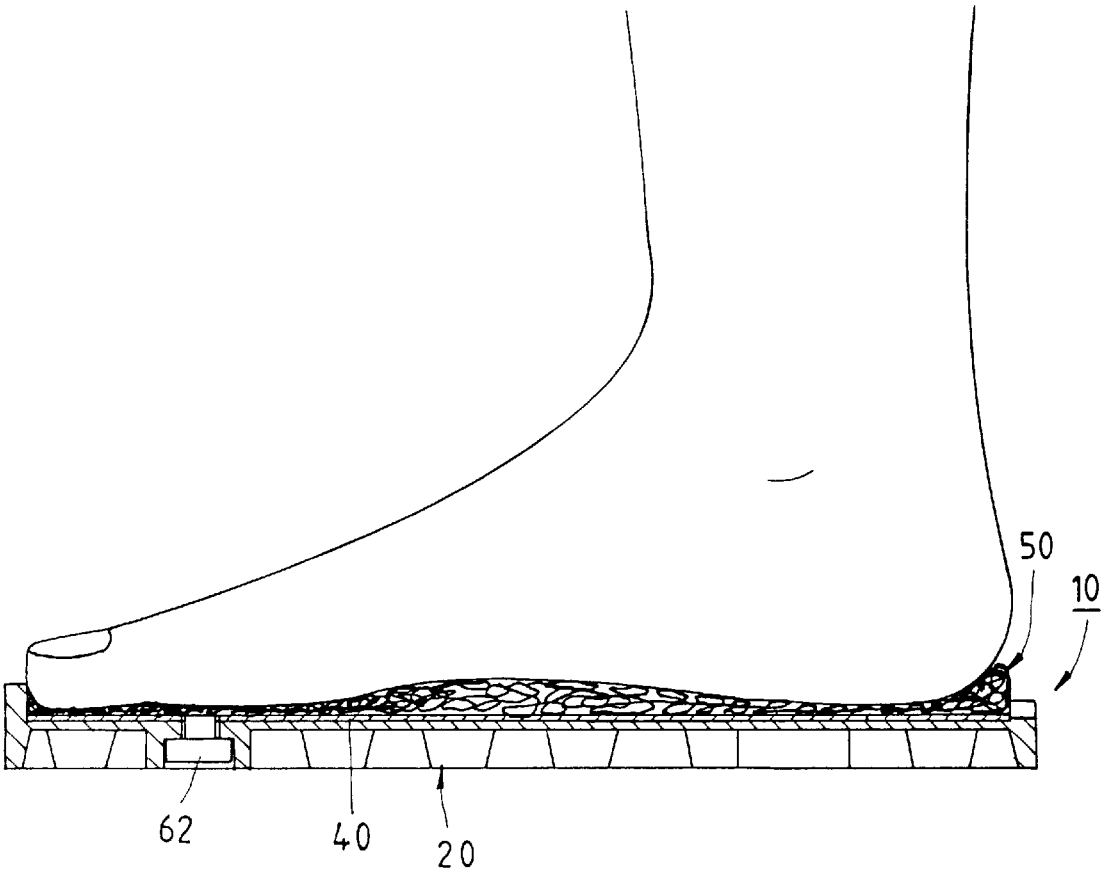
FIG. 4 is a schematic view of the present invention in use.

In use, the user puts his/her foot into the receiving space defined by the upper 60 and steps on the insole 50. The elastic insole 50 will immediately be compressed, as shown in FIG. 4, so that the user's entire foot is surrounded by the raised wall 22 while the toes are stopped by the raised portions 24*a* at the front of the outsole 20.

The present invention has the following advantages in actual use:

1. The gaps of the insole provide good ventilation and draining effects, allowing free flowing of water. When the user wades across water wearing a pair of slippers 10 according to the present invention, the water in the insole 50 will flow downwardly to the top surface of plate 40' and out through the water outlets 26 and will not accumulate between the user's sole and the outsole 20, keeping the user's feet relatively dry. Furthermore, as the insole 50 allows good air ventilation, water moisture will evaporate quickly. As the slipper of the present invention has good draining effects, water and the user's perspiration will not accumulate and the slipper will not create an odor, thus keeping the user's feet healthy.

2. As the outsole 20 is provided with raised portions 24*a* at the front end thereof, when the user stops abruptly while walking quickly or when the user is walking down a slope, the raised portions 24*a* can check the forward movement of the user's sole on the slipper so as to give the user's foot a suitable support, thereby enhancing the performance of sports slippers. Furthermore, the insole 50 can provide suitable friction to the user's foot to prevent skidding.

3. The raised wall 24 further has the function of protecting the user's toes, preventing the toes from being hurt by foreign objects. Besides, the raised wall 24 prevents the insole 50 from hitting against external objects so as to prevent the insole 50 from detaching from the outsole 20.

Although the present invention has been illustrated and described with reference to the preferred embodiment thereof, it should be understood that it is in no way limited to the details of such embodiment but is capable of numerous modifications within the scope of the appended claims.

What is claimed is:

1. A slipper having good draining functions and providing enhance support, comprising:

an outsole having a top face provided with a pre-determined number of upwardly extending raised portions along a periphery thereof, and a pre-determined number of water outlets each having a bottom edge disposed between adjacent raised portions, said top face of said outsole forming a top surface within said raised portion;

an insole formed by a multiplicity of elastic filaments of high polymers that are interwoven in a loose fashion, said interwoven elastic filaments giving said insole a pre-determined thickness and having multiple gaps formed between said filaments, said insole being disposed on said top surface of said outsole and being surrounded by said raised portions; and an upper body secured to said outsole such that it defines an arching receiving space adapted to receive a user's foot;

wherein raised portions at a front edge of said outsole are higher than a remainder of said raised portions.

2. A slipper having good draining functions and providing enhance support, comprising:

an outsole having a top face provided with a pre-determined number of upwardly extending raised portions along a periphery thereof, and a pre-determined number of water outlets each having a bottom edge disposed between adjacent raised portions, said top face of said outsole forming a top surface within said raised portion;

an insole formed by a multiplicity of elastic filaments of high polymers that are interwoven in a loose fashion, said interwoven elastic filaments giving said insole a pre-determined thickness and having multiple gaps formed between said filaments, said insole being disposed on said top surface of said outsole and being surrounded by said raised portions; and an upper body secured to said outsole such that it defines an arching receiving space adapted to receive a user's foot;

wherein said insole has a bottom edge substantially at the same height as the bottom edges of said water outlets.

3. A slipper having good draining functions and providing enhanced support, comprising:

an outsole having an upper face provided with a plurality of upwardly extending raised portions along a periphery thereof, and a plurality of water outlets each having a bottom edge disposed between adjacent raised portions, said upper face of said outsole being below each said bottom edge and forming therewith a depressed area, there is a slight drop in height between said top surface of said outsole and bottom edges of said water outlets so that a shoulder is formed;

a plate disposed on said upper face in said depressed area, said plate having a periphery corresponding to said shoulder;

an insole formed by a multiplicity of elastic filaments of high polymers that are interwoven in a loose fashion, said interwoven elastic filaments giving said insole a compressible thickness having a plurality of gaps formed between said filaments, said insole being disposed on said upper surface of said plate and being surrounded by said raised portions; and an upper body being secured to said outsole to produce an arching receiving space adapted to receive a user's foot.

4. The slipper as claimed in claim 3, wherein raised portions at a front edge of said outsole are higher than a remainder of said raised portions.

5. The slipper as claimed in claim 3, wherein said insole has a bottom edge substantially at the same height as the bottom edges of said water outlets.

6. The slipper as claimed in claim 3, wherein said outsole is provided with an inwardly recessed space at a bottom face thereof, a plurality of spaced projections being arranged in said recessed space.

7. The slipper as claimed in claim 3, wherein an upper surface of said plate is above said bottom edges.

* * * * *